United States Patent [19]

Smith

[11] Patent Number: 4,496,803

[45] Date of Patent: Jan. 29, 1985

[54] DATA ENTRY SWITCH

[75] Inventor: William D. Smith, Placentia, Calif.

[73] Assignee: Key Concepts, Incorporated, Houston, Tex.

[21] Appl. No.: 491,454

[22] Filed: May 4, 1983

[51] Int. Cl.[3] ..... H01H 9/00; H01H 13/50; H01H 15/00

[52] U.S. Cl. ..... 200/5 A; 200/16 A; 200/159 B

[58] Field of Search ..... 200/5 A, 159 R, 159 A, 200/159 B, 275, 340, 16 C, 16 D

[56] References Cited

U.S. PATENT DOCUMENTS

| | | | |
|---|---|---|---|
| Re. 30,923 | 5/1982 | Durkee et al. | 200/5 A |
| 3,780,237 | 12/1973 | Seeger, Jr. et al. | 200/340 X |
| 3,809,838 | 5/1974 | Coppola | 200/159 R |
| 3,857,008 | 12/1974 | Van Der Donk | 200/159 R X |
| 3,941,964 | 3/1976 | Yoder | 200/5 A X |
| 3,973,091 | 8/1976 | Kaminski | 200/5 A |
| 4,000,389 | 12/1976 | Misson et al. | 200/159 R X |
| 4,129,763 | 12/1978 | Murata | 200/159 R X |
| 4,418,252 | 11/1983 | Daigle | 200/340 X |

*Primary Examiner*—J. R. Scott

*Attorney, Agent, or Firm*—Pravel, Gambrell, Hewitt & Kimball

[57] ABSTRACT

A new and improved switch incorporating an integral contact and return spring element for use in data entry keyboards is disclosed. The unitary contact and return spring element includes a spring member and a contact member. At rest, only the spring member contacts the underlying circuit board at a first terminal. If the spring contact is compressed a suitable distance, however, the contact member contacts a second portion of the circuit board to complete a circuit between the first and second terminal. The unitary contact and return spring element may include a plurality of spring contact members overlying an equal number of circuit board terminals. The use of multiple spring and contact elements allows use of double-pole, double-throw and double-pole, break-before-make embodiments.

6 Claims, 13 Drawing Figures

DATA ENTRY SWITCH

BACKGROUND OF THE INVENTION

1. Field of the Invention:

The present invention relates to electrical switches of the type used in data entry keyboards for calculators, computers or the like. In such keyboards an array of switches is generally provided which may be designated to correspond to particular functions, or alphanumeric characters, and which are activated by depressing a key top from an elevated at rest position downward toward an underlying circuit board.

2. Description of the Prior Art:

Insofar as is known, all of the switches found in the prior art have certain limitations in ease of manufacture, assembly and wear which are not found in the present invention. Prior switches have generally been multiple piece assemblies, which were expensive to manufacture and difficult to assemble. Furthermore, prior switching elements were subject to severe wearing problems due to the interaction of the assembled parts.

SUMMARY OF THE INVENTION

Briefly, the present invention provides a new and improved switch which incorporates a novel contact switching element for use with data entry keyboards in conjunction with an underlying printed circuit board. The contact switching element of the present invention is formed of a single piece of conductive material. In a single pole, single throw configuration, the element includes a spring member which generally maintains contact with the circuit board and biases the element upward, and a contact member for completing the circuit when the switch is activated. The contact member overlays a terminal on the printed circuit board when the switch is open and is brought into contact with the terminal to complete an electrical circuit between the terminals on the circuit board via the contact element. Double-pole, double-throw embodiments as well as double-pole, break-before-make embodiments using multiple spring and contact elements may be made using the teachings of the present invention.

DESCRIPTION OF THE PREFERRED EMBODIMENT

Figure 1:
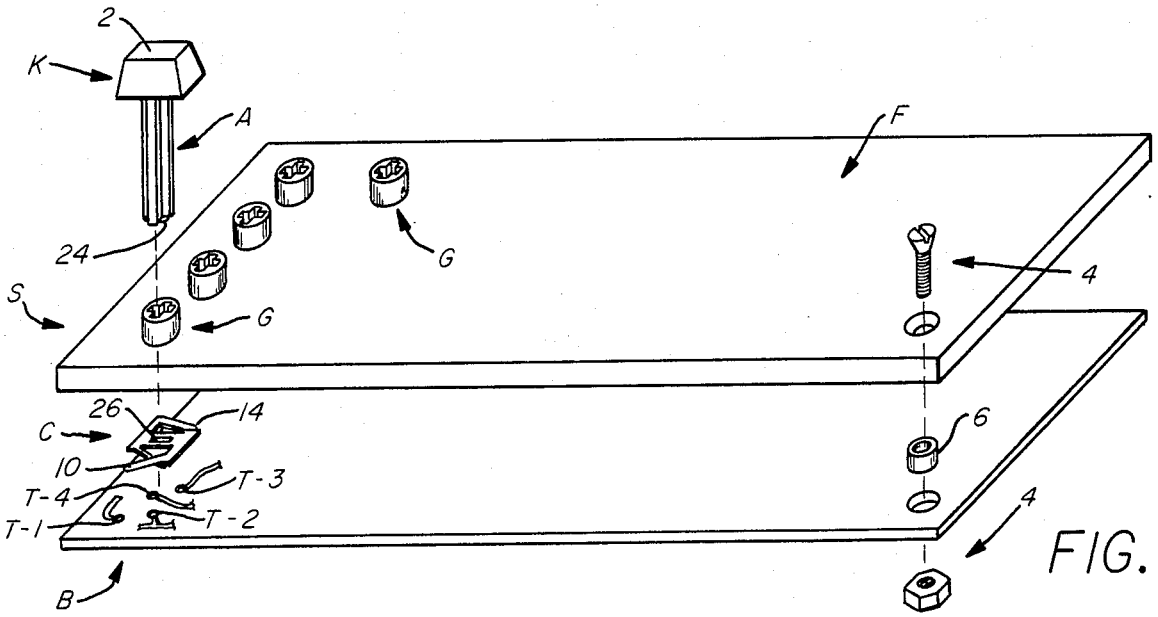
FIG. 1 is an isometric view of a switch according to the present invention in association with an electrical circuit board.

In the drawings, the letter S designates a switch according to the present invention for use with an underlying circuit board B. Switch S includes integral contact spring element C, switch actuator A, and actuator guide G. A key top K is mounted to actuator A, or alternatively, actuator A may be formed to include key top K as a single integral unit. A surface 2 of key top K carries a designation or indicator, whether letter, number or otherwise, corresponding to the particular function of the underlying switch S to be selected by a user.

In most applications, an array of switches S are provided for use with underlying circuit board B (FIG. 1). In these multiple switch applications, a frame F is provided with a plurality of actuator guides G, so that a plurality of switches S may be positioned to overlay different terminals T on the circuit board B. Circuit board B may be mounted to frame F and held in place using any suitable mounting method such as threaded connectors 4 and spacers 6 to maintain switch S in appropriate position relative to board B. Any suitable mounting means such as pin and socket arrangements as are known in the art may be likewise used to position board B relative to frame F.

Considering the switch S in greater detail, contact spring element C (FIGS. 2 and 3) is manufactured from a single piece of planar conductive material such as stainless steel where long service life is desired, it should be understood, however, that other conductive materials could equally as well as used. Element C includes contact body 8, spring member 10, and contact member 12. Although shown in the FIG. 2 in a generally rectangular shape, it should be understood that contact spring element C may be manufactured in other shapes to suit particular design requirements, such as the circular embodiment C-1 shown in FIGS. 4 and 5.

Figure 2:
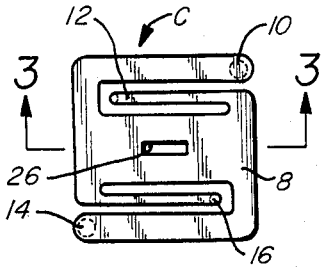
FIG. 2 is a top view of a switching element according to the present invention.

Referring now to FIG. 2, in the double-pole single throw embodiment of switch S, contact spring element C is provided with a second spring member 14 and a second contact member 16 formed in like manner as members 10 and 12 respectively. Spring members 10 and 14 are formed from the perimeter of contact spring element C so as to be longer than contact elements 12 and 16 which are formed from interior portions of element C. While it is not required that spring members 10 and 14 be longer than contact members 12 and 16, such sizing facilitates the orientation of the distal end of spring members 10 and 14 in contact with circuit board B, relatively lower than the distal or lower ends of contact members 12 and 16 (FIG. 6).

Figure 3:
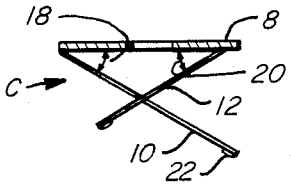
FIG. 3 is a cross-sectional view taken along the lines 3—3 in FIG. 2.

Spring members 10 and 14 depend from body 8 at an angle 18. Thus, spring members 10 and 14 in conjunction with body 8 form a spring for resiliently supporting element C over circuit board B in a manner to be described below. Contact members 12 and 16 similarly depend from body 8 at an angle 20 (FIG. 3). For purposes of clarity element C is shown in cross section in FIG. 3 so that only spring member 10 and contact member 12 are illustrated, but it should be understood that spring member 14 and contact member 16 depend from body 8 in the same fashion as members 10 and 12, respectively.

Each of members 10, 12, 14 and 16 is provided with a contact pad 22 at its respective distal end for establishing electrical contact with a terminal on circuit board B. Contact pad 22 may be formed of any suitable conductive material, having satisfactory durability and conductivity. For example, contact pad 22 may be formed of semi precious metals such as copper or precious metals like silver or gold or alloys thereof to improve the conductivity and reliability of the electrical connection between contact element C and the circuit board B.

Figure 6:
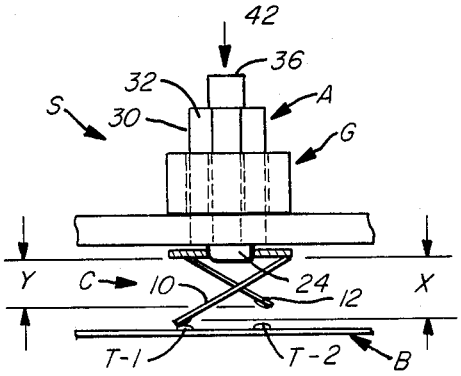
FIG. 6 is a side elevation of a switch according to the present invention in association with an underlying electrical circuit board.

Referring now to FIG. 6, switch S is closed when contact spring element C is compressed by movement of actuator A toward circuit board B in the direction illustrated by arrow 42 under force imposed by a user's finger. Actuator A includes a fusible mounting tang 24 for mounting actuator A to element C at slot 26 (FIGS. 2 and 6). Tang 24 is initially formed to pass through slot 26 and is thereafter heated and enlarged to secure actuator A to element C. Switch S and actuator A are positioned over appropriate portions of circuit board B by guide G. If an array of switches S are provided, a plurality of guides G are arranged in frame F to overlay appropriate contact terminals of circuit board B. Since each such switch S operates in identical fashion, only a single switch S and guide G need be described.

Figure 7:
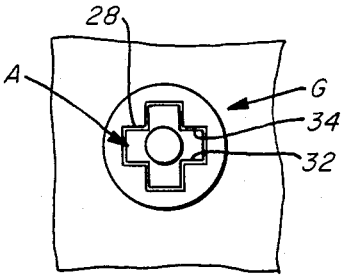
FIG. 7 is a top view of a portion of the switch shown in FIG. 6.

Guide G includes a passageway 28 which closely receives stem 30 of actuator A (FIG. 6) thereby laterally positioning actuator A over circuit board B. In the preferred embodiment, stem 30 is formed with four longitudinal ribs 32 (FIGS. 6 and 7) extending substantially over the length of stem 30, each of ribs 32 being substantially rectangular in cross section (FIG. 7). Other cross-sectional configurations could also be used, if desired. Guide G is provided with rectangular channels 34 in passageway 28 which correspond to ribs 32. Thus, actuator A may traverse through guide G vertically without restriction, but is prevented from rotating or moving laterally. In those applications wherein it is desirable to use a two-piece actuator A, i.e., where it is desirable to use a separate key top K (FIG. 1) a key top mounting tang 36 is provided at the upper end of actuator A.

Referring now to FIG. 6, an assembled switch S is illustrated in at rest position. For purposes of clarity, since spring members 10 and 14, and contact members 12 and 16 function identically, only spring member 10 and contact member 12 are illustrated. The distal or lower ends of spring members 10 and 14 extend below body 8 of element C towards terminals T-1 and T-3, respectively, of circuit board B. A total switch travel distance X is prescribed by the length and angle of dependency 18 of spring members 10 and 14. The distal or lower ends of contact members 12 and 16 extend below body 8 at an angle 20 and a distance Y, which is less than distance X, to overlay terminals T-2 and T-4 of the circuit board B.

The switch S is activated by depressing actuator A toward circuit board B in the direction indicated by an arrow 42, which movement eventually causes contact member 12 to contact terminal T-2 thereby completing an electrical circuit from T-1 to T-2 via conductive contact spring element C. If terminals T-1 and T-3, which contact spring members 10 and 14, are used as electrically common terminals, and terminals T-2 and T-4 are connected to different circuits on circuit board B, the switch S functions to connect the two circuits at terminals T-2 and T-4 to a common circuit at T-1 and T-3.

Figure 4:
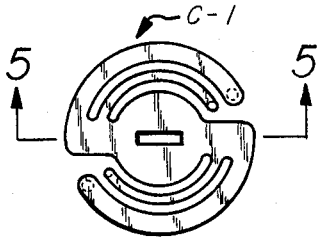
FIG. 4 is a top view of another embodiment of a switching element according to the present invention.
Figure 5:
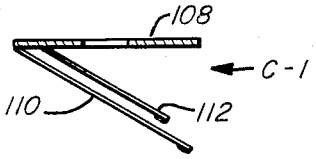
FIG. 5 is a cross-sectional view taken along the lines 5—5 in FIG. 4.

An alternative embodiment contact spring element C-1 is illustrated in FIGS. 4 and 5, and can be seen to have an overall shape which is circular. Spring members 110 and 114, and contact members 112 and 116 correspond in function to members 10, 12, 14 and 16 of element C illustrated in FIGS. 2 and 3 and described above. Thus, element C-1 functions in a like manner to element C, differing only in overall shape or configuration.

Figure 8:
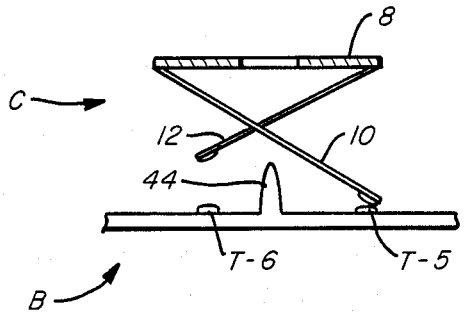
FIG. 8 is a cross-sectional view of another embodiment of a switching element according to the present invention in association with an underlying electrical circuit board.
Figure 10:
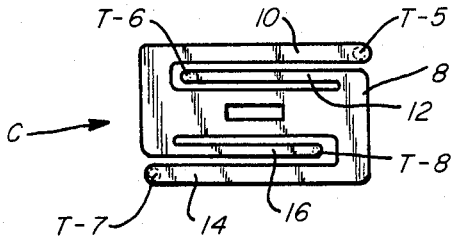

In switching applications it is sometimes desirable to break or open a first circuit before making or closing a second circuit. An embodiment of switch S which performs this function is illustrated in FIGS. 8 and 10. In FIGS. 8 and 10, contact spring element C is shown positioned above circuit board B, with spring members 10 and 14 in contact with terminals T-5 and T-7, respectively. Contact members 12 and 16 overlay terminals T-6 and T-8, respectively. When switch S is at rest, a circuit is completed between terminals T-5 and T-7 of the circuit board B via spring members 10 and 14. When the switch S is depressed causing contact members 12 and 16 to contact terminals T-6 and T-8 respectively, a second circuit is completed between terminals T-6 and T-8 via contact element C. In order to open the circuit between terminals T-5 and T-7 before completing the circuit between terminals T-6 and T-8, a ridge or protusion 44 which functions as a fulcrum is formed on circuit board B extending below element C so as to engage spring members 10 and 14 as element C is compressed toward circuit board B. Thus, as element C moves toward circuit board B, elements 10 and 14 engage fulcrum 44 and are cammed away to thus disengage from terminals T-5 and T-7, respectively. Fulcrum 44 is of sufficient height to cause members 10 and 14 to disengage prior the engagement of contact members 12 and 16 with terminals T-6 and T-8, respectively. Thus, in a single switching action the circuit between terminals T-5 and T-7 is opened and that between terminals T-6 and T-8 is closed.

Figure 9:
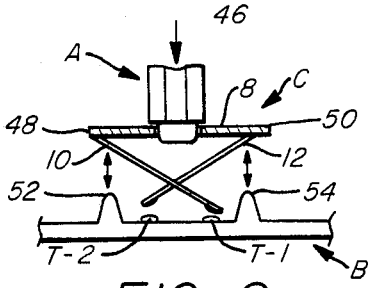
FIG. 9 is a cross-sectional side view of another embodiment of a switching element according to the present invention in association with an underlying electrical circuit board; and, FIG. 10 is a top view of the switch of FIG. 8.

In still other switching applications, it is desirable to provide an initial switch travel in response to relatively light force but to require an increased mechanical force or pressure on actuator A during the final portion of actuator travel necessary to complete the circuit. An embodiment of switch S which provides this characteristic is illustrated in FIG. 9. Spring contact element C is illustrated in at rest position, supported over circuit board B by spring member 10 which is in contact with terminal T-1. Contact member 12 overlays terminal T-2. As element C is urged toward circuit board B in the direction shown by arrow 46, opposed portions 48 and 50 of body 8 are engaged by stops 52 and 54, respectively.

Stops 52 and 54 are formed on circuit board B to lie under portions 48 and 50 of body 8, so that when switch S is activated, body 8 is engaged by stops 52 and 54 before contact member 12 engages terminal T-2. In this fashion, during the final portion of switch travel, the user is required to exert sufficient force on actuator A to flex body 8 of element C toward circuit board B far enough to cause contact member 12 to contact terminal T-2. The amount of force required is, of course, dependent upon the flexibility of body 8 of element C and the height of stops 52 and 54 above circuit board B.

Figure 11:
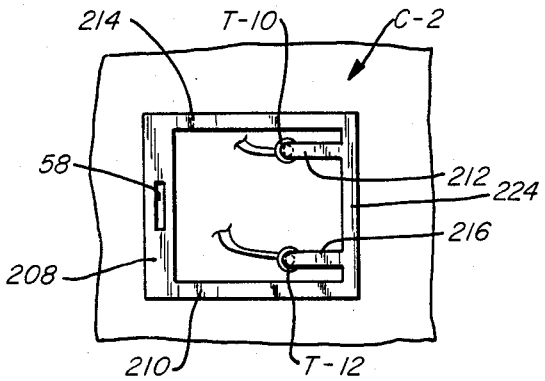
FIG. 11 is a top view of another embodiment of a switching element according to the present invention in association with an underlying electrical circuit board.
Figure 12:
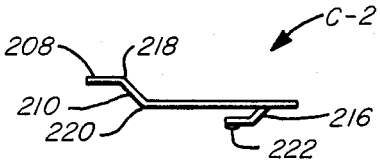
FIG. 12 is a side view of the switching element of FIG. 11.
Figure 13:
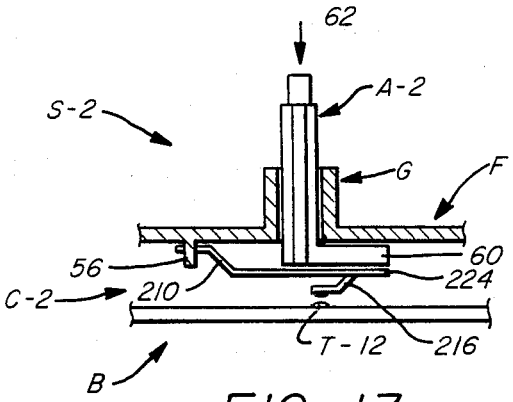
FIG. 13 is a cross-sectional side view of another embodiment of a switch according to the present invention in association with an underlying electrical circuit board.

Still another embodiment of the present invention is illustrated in FIGS. 11–13 and designated S-2. In this embodiment, contact spring element C-2 is formed of resilient, conductive material as in the other embodiments described herein. Element C-2 is formed in a substantially rectangular configuration, and includes a spring body 208, spring members 210 and 214, and contact members 212 and 216. These elements generally correspond in function to members 8, 10, 12, 14 and 16 of element C illustrated in FIGS. 2 and 3 and described above. In this embodiment, however, frame F is provided with a fusible mounting tang 56 for mounting element C-2 at slot 58 (FIGS. 11 and 13). Thus, element C-2 is suspended from frame F between actuator A-2 and circuit board B rather than being supported upon the circuit board B (FIG. 12). Members 210 and 214 of body 208 are each formed with corresponding and opposite bends at points 218 and 220 so that body 208 is positioned substantially parallel to and midway between frame F and circuit board B (FIG. 12).

Contact members 212 and 216 depend from body 208 and are provided with contact pads 222 which correspond in function to pads 22 of element C illustrated in FIGS. 2 and 3 and described above. Contact members 212 and 216 are suspended above terminals T-10 and T-12 of circuit board B, respectively (FIG. 11).

Actuator A-2 (FIG. 13) is provided with a lateral extension 60 which engages transverse section 224 of body 208 when switch S-2 is closed (FIGS. 11,13). Referring now to FIG. 13, switch S-2 is closed when contact spring element C-2 is deflected by actuator A-2 from its at rest position toward circuit board B in the direction illustrated by arrows 62 under force imposed by a user's finger. For purposes of clarity, since spring members 210 and 214, contact members 212 and 216, and terminals T-10 and T-12 function identically only spring member 210, contact member 216 and terminal T-12 are illustrated in FIG. 12. Movement of actuator A-2 in the direction of arrows 62 eventually causes contact member 216 to contact terminal T-12 thereby completing an electrical circuit from T-10 to T-12 via conductive contact spring element C-2.

Thus, an easily manufactured and durable switch S is provided with the present invention which is readily adaptable for use with data entry keyboards. The switch S includes a unique one piece spring contact element which facilitates assembly of keyboard switches and provides superior wearing characteristics.

The foregoing disclosure and description of the invention are illustrative and explanatory thereof, and various changes in the size, shape and materials as well as in the details of the illustrated construction may be made without departing from the spirit of the invention.

I claim:

1. A switch for selectively completing a circuit between terminals on a circuit board underlying a movable operator key such as in data entry keyboards or the like, comprising:

a contact spring body formed of a flexible material;

a spring member, depending from said body and extending therebelow to contact a first terminal on the circuit board;

a contact member, depending from said body and extending therebelow to overlay a second terminal on the circuit board when said switch is at rest and to contact the second terminal when said body is urged toward the circuit board thereby completing an electrical circuit between the first terminal and second terminal of the circuit board via said contact spring body; and body stop means for engaging a portion of the periphery of said body as said body is urged toward the circuit board, said body stop means comprising a first projection and a second projection, said projections extending upward from the circuit board and being arranged at points on the circuit board so as to engage substantially opposed portions of the periphery of said body.

2. The switch of claim 1 wherein said body, said spring member, and said contact member are formed from a single conductive element.

3. The switch of claim 1, further comprising:

unitary switch actuator means mounted to said contact spring body and extending upward therefrom for engagement by the user to actuate the switch, said actuator means comprising an elongated actuator stem having an upper end and a lower end, said lower end of said stem being mounted to said contact spring body, and said upper end of said stem being adapted to receive an operator key top.

4. The switch of claim 1 wherein said contact spring means is formed of stainless steel.

5. A switch for selectively completing a circuit between terminals on a circuit board underlying a movable operator key such as in data entry keyboards or the like comprising:

a contact spring body;

a first spring means for supporting said body above the circuit board, said first spring means depending from said body and extending therebelow to contact a first terminal on the circuit board;

a first contact member depending from said body and extending therebelow to overlay a second terminal on the circuit board when said switch is at rest and to contact the second terminal when said body is urged toward the circuit board thereby completing a first electrical circuit between the first terminal and second terminal of the circuit board via said contact spring body;

second spring means depending from said body and extending therebelow to contact a third terminal on the circuit board;

a second contact member depending from said body and extending therebelow to overlay a fourth terminal on the circuit board when said switch is at rest and to contact the fourth terminal when said body is urged toward the circuit board, thereby completing a second electrical circuit between the third and fourth terminals of the circuit board via said contact spring body;

fulcrum means, mounted with the circuit board, and adapted to engage said spring means above the point of contact between said spring means and the circuit board as said body is urged toward the circuit board thereby causing said spring means to disengage from the terminal; and wherein said fulcrum means is formed so as to engage said spring means causing said spring means to disengage from the first and third terminals of the circuit board as the switch is urged toward the circuit board and before said contact members contact the second and fourth terminals of the circuit board.

6. The switch of claim 5, wherein said fulcrum means comprises:

a first raised bead, formed on the circuit board adjacent the first terminal; and a second raised bead formed on the circuit board adjacent the third terminal.

* * * * *

UNITED STATES PATENT AND TRADEMARK OFFICE

CERTIFICATE OF CORRECTION

PATENT NO. : 4,496,803

DATED : January 29, 1985

INVENTOR(S) : William D. Smith

It is certified that error appears in the above-identified patent and that said Letters Patent are hereby corrected as shown below:

In Column 2, Line 44: delete "as well as" and insert therefor --as well be--.

In Column 3, Line 15: delete "semi precious" and insert therefor --semiprecious--.

In Column 4, Line 34-35: delete "protusion" and insert therefor --protrusion--.

Signed and Sealed this

*Ninth* Day of *July 1985*

[SEAL]

*Attest:*

DONALD J. QUIGG

*Attesting Officer* *Acting Commissioner of Patents and Trademarks*